US011184957B2

(12) United States Patent
Li et al.

(10) Patent No.: US 11,184,957 B2
(45) Date of Patent: Nov. 23, 2021

(54) ELECTRONIC HEATING SMOKING PARAPHERNALIA CAPABLE OF BEING ROTATED TO EXTRACT CIGARETTE AND METHOD FOR EXTRACTING CIGARETTE BY ROTATING SMOKING PARAPHERNALIA

(71) Applicant: CHINA TOBACCO YUNNAN INDUSTRIAL CO., LTD, Kunming (CN)

(72) Inventors: Zhiqiang Li, Kunming (CN); Shanzhai Shang, Kunming (CN); Ping Lei, Kunming (CN); Jingmei Han, Kunming (CN); Chengya Wang, Kunming (CN); Ru Wang, Kunming (CN); Xu Zeng, Kunming (CN); Dong Xiao, Kunming (CN); Dalin Yuan, Kunming (CN); Lingxuan Liu, Kunming (CN); Nengjun Xiang, Kunming (CN); Lei Wang, Kunming (CN); Yongkuan Chen, Kunming (CN)

(73) Assignee: CHINA TOBACCO YUNNAN INDUSTRIAL CO., LTD, Kunming (CN)

( * ) Notice: Subject to any disclaimer, the term of this patent is extended or adjusted under 35 U.S.C. 154(b) by 296 days.

(21) Appl. No.: 16/458,207

(22) Filed: Jul. 1, 2019

(65) Prior Publication Data

US 2020/0093183 A1 Mar. 26, 2020

(30) Foreign Application Priority Data

May 4, 2018 (CN) ..... 201810420848.8

(51) Int. Cl.
*H05B 3/44* (2006.01)

(52) U.S. Cl.
CPC ..... *H05B 3/44* (2013.01); *H05B 2203/022* (2013.01)

(58) Field of Classification Search
CPC ..... A24F 40/20; A24F 40/40; A24F 47/008; H05B 2203/022; H05B 1/0227
See application file for complete search history.

(56) References Cited

U.S. PATENT DOCUMENTS

| | | | | |
|---|---|---|---|---|
| 9,693,587 | B2 * | 7/2017 | Plojoux | A61M 15/06 |
| 2009/0095311 | A1 * | 4/2009 | Han | A24F 40/46 131/194 |
| 2018/0020725 | A1 * | 1/2018 | Alarcon | A61M 11/042 131/329 |

FOREIGN PATENT DOCUMENTS

CN 103997922 B 12/2016

* cited by examiner

*Primary Examiner* — Jean F Duverne
(74) *Attorney, Agent, or Firm* — Bayramoglu Law Offices LLC

(57) ABSTRACT

An electronic heating smoking paraphernalia capable of being rotated to extract a cigarette includes a heating unit, a heating unit protection cover, wherein the heating unit passes through a through hole to achieve a coaxial arrangement with the heating unit protection cover, an outer wall is provided with an annular protrusion and a side wall is provided with a limiting groove; a heating cavity shell, wherein the heating cavity shell is sleeved outside the heating unit protection cover, an inner wall is provided with an annular groove, the annular groove is matched with the annular protrusion, an inner wall is further provided with a sliding guide groove; and a cigarette holding cavity, wherein an outer wall is provided with protrusions, the protrusions penetrate through the limiting groove and an end of each protrusion is limited in the sliding guide groove.

7 Claims, 3 Drawing Sheets

ELECTRONIC HEATING SMOKING PARAPHERNALIA CAPABLE OF BEING ROTATED TO EXTRACT CIGARETTE AND METHOD FOR EXTRACTING CIGARETTE BY ROTATING SMOKING PARAPHERNALIA

CROSS REFERENCE TO THE RELATED APPLICATIONS

This application is based upon and claims priority to Chinese Patent Application No. 201810420848.8, filed on May 4, 2018, the entire contents of which are incorporated herein by reference.

TECHNICAL FIELD

The present invention belongs to the field of novel cigarette smoking paraphernalia, particularly relates to an electronic heating smoking paraphernalia capable of being rotated to extract a cigarette and a method for extracting the cigarette by rotating the smoking paraphernalia.

BACKGROUND

A novel heat-not-burn cigarette product heats tobacco through an external heat source up to a temperature lower than the combustion temperature of a conventional cigarette. In this way, the heat-not-burn cigarette is heated to its volatilization temperature to produce smoke, and will highly reduce massive harmful substances produced by the combustion of the cigarette, so as to reduce harm of passive smoking to the non-smokers.

However, among the existing novel heat-not-burn cigarette products, the cigarette needs to be extracted through an axial retractable cigarette extractor (such as an extractor disclosed in CN103997922B). When doing this way, the operator has to be particularly careful. If users don't pull out the extractor strictly in an axial direction of the smoking paraphernalia, the cigarette will push and press the heating units in the process of extracting the cigarette, particularly for sheet heating units, the sheet heating units may depart from an axial center line and bend. When the heating units seriously depart from the axial center line or the heating units are bent for a long time, the heating units cannot be smoothly inserted into the cigarette when the users insert the cigarette into a cigarette holding cavity. Furthermore, the heating units may break. Besides, if the extractor is not pulled out strictly in the axial direction, a horizontal bending of the heating unit may push and press the tobacco inside the cigarette, resulting in that the tobacco scraps fall off and accumulate in the heating cavity, thus affecting the subsequent cleaning and using.

It is therefore an objective for the present invention to address the above-mentioned problems.

SUMMARY

In a first aspect, the present invention provides an electronic heating smoking paraphernalia capable of being rotated to extract a cigarette which includes:

a heating unit;

a heating unit protection cover having a cylinder-like shape, wherein a center at a bottom of the heating unit protection cover is provided with a through hole, the heating unit passes through the through hole to achieve a substantially coaxial arrangement with the heating unit protection cover, an outer wall of the heating unit protection cover is provided with an annular protrusion, and a side wall of the heating unit protection cover is provided with a limiting groove having a height substantially equal to a height of the heating unit protection cover and arranged in the longitudinal axial direction;

a cigarette heating cavity shell, wherein the cigarette heating cavity shell is sleeved outside the heating unit protection cover, an inner wall of the heating cavity shell is provided with an annular groove, the annular groove is matched with the annular protrusion to make the heating cavity shell capable of rotating in situ around the heating unit protection cover, an inner wall of the heating cavity shell is further provided with a sliding guide groove; and a cigarette holding cavity, wherein an outer wall of the cigarette holding cavity is provided with protrusions, the protrusions penetrate through the limiting groove and an end of each of the protrusions is limited in the sliding guide groove.

Specifically, the sliding guide groove has a spiral shape.

Preferably, a length of the sliding guide groove extending in the longitudinal axial direction is less than or equal to a length of a section of the heating unit inserted in the heating unit protection cover. The advantage of doing so is to prevent the cigarette holding cavity from being completely pulled out of the heating cavity shell, so as to avoid the falling off and loss of the cigarette holding cavity.

Preferably, the electronic heating smoking paraphernalia capable of being rotated to extract the cigarette further includes a housing, wherein a battery, and a controlling and fixing module are provided inside the housing, the heating unit is electrically connected to the battery and the controlling and fixing module, and fixed on the controlling and fixing module.

In a second aspect, the present invention provides a method for extracting the cigarette by rotating the smoking paraphernalia in the electronic heating smoking paraphernalia capable of being rotated to extract the cigarette according to the first aspect of the present invention, wherein the method includes the following steps:

a: rotating the heating cavity shell, wherein owing to the existence of the annular groove on the inner wall of the heating cavity shell and the annular protrusion on the outer wall of the heating unit protection cover, and the longitudinal axial limiting effect thereof, the heating cavity shell can merely rotate in situ around the heating unit protection cover, rather than move longitudinally;

b: in the rotation process, the sliding guide groove inside the heating cavity shell applying a force to the protrusions on two sides of the cigarette holding cavity, wherein since the sliding guide groove is in the spiral shape, the protrusions penetrate through the longitudinal limiting groove on the heating unit protection cover and the heating unit protection cover doesn't rotate, the rotation of the protrusions is limited, so the protrusions can merely move in the longitudinal axial direction defined by the limiting groove, drive the cigarette holding cavity to move in the longitudinal axial direction, and further drive the cigarette in the cigarette holding cavity to move in the longitudinal axial direction and gradually away from the heating unit till the cigarette is pulled out of the heating unit eventually.

Preferably, step b is followed by step c which includes:

c: reversely rotating the heating cavity shell along the heating unit protection cover, then the cigarette holding cavity moving along the limiting groove in the longitudinal axial direction and returning to an original position, for a next cigarette to be inserted for smoking.

The present invention has the following advantages.

1. Due to the ingenious design of mechanisms, the cigarette holding cavity is able to move strictly in the longitudinal axial direction, thereby driving the cigarette to move strictly in the longitudinal axial direction. As a result, there is no radial force or lateral force applied to the heating unit, ensuring that the heating unit does not bend, and effectively prolonging the service life of the heating unit.

2. Since lateral load between the heating unit and the cigarette is eliminated, almost no tobacco scrap falls off, thus solving the issue of tobacco accumulation in the heating cavity caused by an improper operation when extracting the cigarette.

Figure 1:
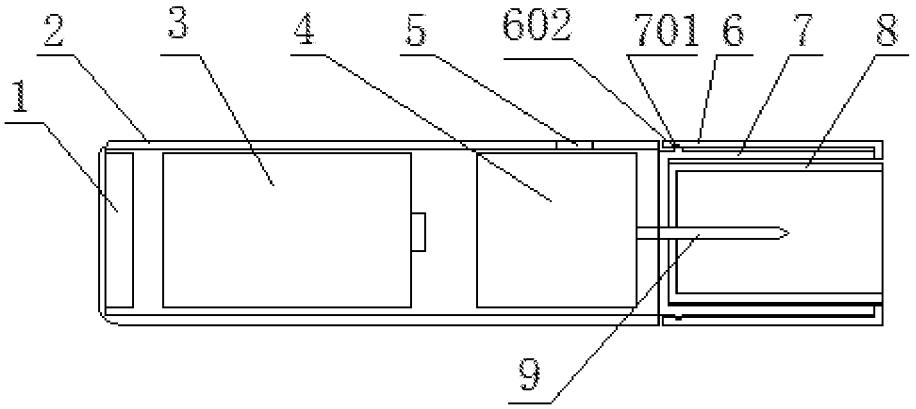
FIG. 1 is a structural schematic diagram of an electronic heating smoking paraphernalia capable of being rotated to extract a cigarette of the present invention.
Figure 2:
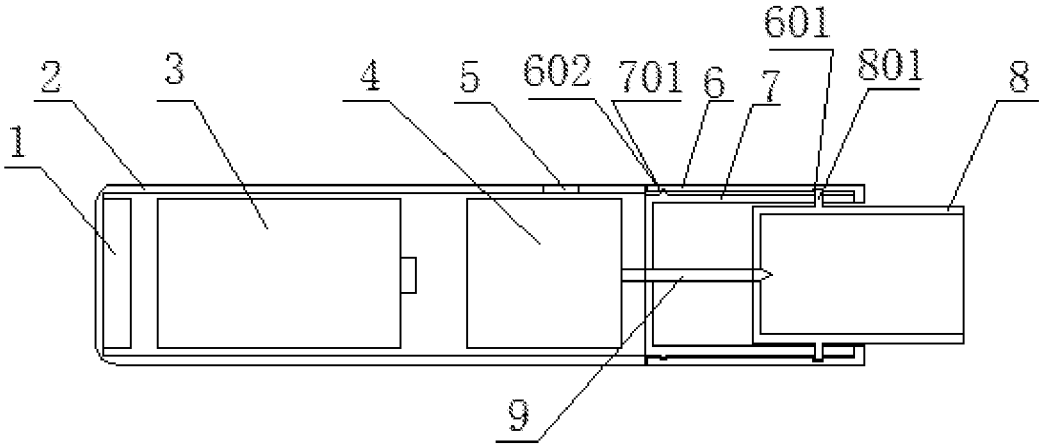
FIG. 2 is a structural schematic diagram showing the smoking paraphernalia shown in FIG. 1 where a heating cavity shell rotates by a certain angle to drive a cigarette holding cavity to move away from a heating unit.
Figure 3A:
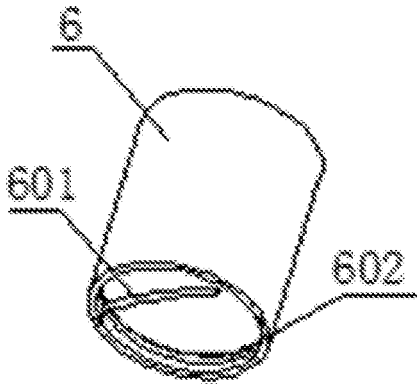
FIG. 3A is a perspective view showing a heating cavity shell of the present invention.
Figure 3B:
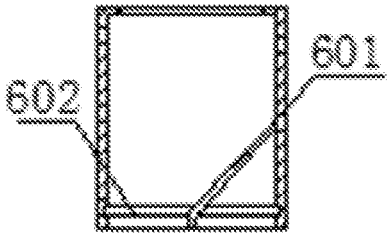
FIG. 3B is a sectional view of a heating cavity shell of the present invention.
Figure 4A:
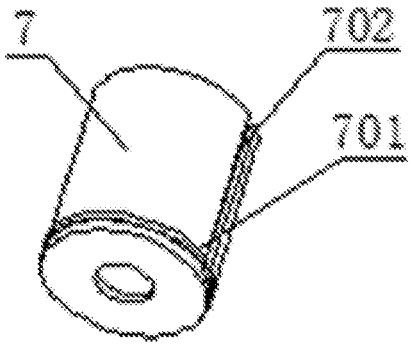
FIG. 4A is a perspective view showing a heating unit protection cover of the present invention.
Figure 4B:
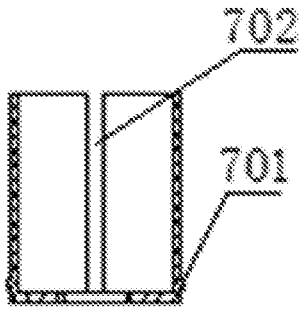
FIG. 4B is a sectional view of a heating unit protection cover of the present invention.

The reference designators in the drawings are described as follows:

1: charging module; 2: housing; 3: battery; 4: controlling and fixing module; 5: start button; 6: heating cavity shell; 7: heating unit protection cover; 8: cigarette holding cavity; 9: heating unit; 601: sliding guide groove; 602: annular groove; 701: annular protrusion; 702: limiting groove; 801: protrusion.

DETAILED DESCRIPTION OF THE EMBODIMENTS

The present invention will be described hereinafter with reference to the drawings. The embodiments below are merely intended to explain the technical solutions of the present invention more clearly, rather than limiting the scope of the present invention.

A heat-not-burn smoking paraphernalia capable of being rotated to extract a cigarette includes the cigarette holding cavity 8, the heating cavity shell 6, the heating unit 9 provided inside the cigarette holding cavity 8, and the heating unit protection cover 7 provided outside the cigarette holding cavity 8 for protecting the heating unit 9. The heating unit 9 may have a sheet shape, a needle shape or other shapes.

A bottom of the heating unit protection cover 7 is connected to the heating unit 9. The heating unit 9 is connected to a power supply assembly. A side wall of the heating unit protection cover 7 is longitudinally provided with the limiting groove 702.

An inner wall of the heating cavity shell 6 is provided with a plurality of the annular grooves 602. An outer wall of the heating unit protection cover 7 is provided with a plurality of annular protrusion 701, enabling the heating cavity shell 6 and the heating unit protection cover 7 to form a stable rotating structure, and enabling the heating cavity shell 6 to rotate in situ along the heating unit protection cover 7.

The inner wall of the heating cavity shell 6 is provided with the sliding guide groove 601 in a spiral shape. Two sides of the cigarette holding cavity 8 are provided with the protrusions 801. Owing to the in situ rotation of the heating cavity shell 6 around the heating unit protection cover 7, and the rotation limiting effect of the limiting groove 702, the sliding guide groove 601 in the heating cavity shell 6 drives the protrusions 801 on the two sides of the cigarette holding cavity 8 to longitudinally move to make the cigarette holding cavity 8 move along the limiting groove 702 on the heating unit protection cover 7, thereby pulling the cigarette strictly in the longitudinal axial direction out of the heating unit.

The electronic heating smoking paraphernalia may further include the charging module 1, the housing 2, the battery 3, the controlling and fixing module 4, and the start button 5. The charging module 1, the battery 3, and the controlling and fixing module 4 are all provided inside the housing 2, and are normally connected to one another for controlling and charging the heating unit. The start button 5 is connected to the controlling and fixing module 4, and provided on a side of the housing 2. The charging module 1 can charge the battery 3 from a main power supply box or an external power supply. An output end of the controlling and fixing module 4 is connected to a bottom of the heating unit 9, so as to control the heating unit 9 to heat the cigarette, and fix and support the heating unit 9, making the heating unit 9 extend longitudinally.

After smoking, the cigarette extracting process of the present invention is as follows:

a. The heating cavity shell 6 is rotated manually. Owing to the existence of the annular groove 602 on the inner wall of the heating cavity shell 6 and the annular protrusion on the outer wall of the heating unit protection cover 7, and the longitudinal axial limiting effect thereof, the heating cavity shell 6 can merely rotate in situ around the heating unit protection cover 7 rather than move longitudinally;

b. In the rotation process, the sliding guide groove 601 in the heating cavity shell 6 will apply a force to the protrusions 801 on two sides of the cigarette holding cavity 8. Since the sliding guide groove 601 is in the spiral shape, if there is no limitation, the sliding guide groove 601 will drive the protrusions 801 to perform a spiral movement (namely, a combination of a rotation and a longitudinal movement). However, the protrusions 801 penetrate through the longitudinal limiting groove 702 on the heating unit protection cover 7 and the heating unit protection cover 7 doesn't rotate, so the rotation of the protrusions 801 is limited, thus the protrusions 801 can merely move in the longitudinal direction defined by the limiting groove 702 and drives the cigarette holding cavity 8 to move in the longitudinal direction, and further drive the cigarette in the cigarette holding cavity 8 to move in the longitudinal direction, the cigarette gradually moves away from the heating unit 9 till being pulled out of the heating unit eventually;

c. The heating cavity shell 6 rotates reversely along the heating unit protection cover 7, then the cigarette holding cavity 8 longitudinally moves along the limiting groove 702 and returns to an original position, for a next cigarette to be inserted for smoking.

What is claimed is:

1. An electronic heating smoking paraphernalia capable of being rotated to extract a cigarette, comprising:

a heating unit;

a heating unit protection cover having a cylinder-like shape, wherein a center at a bottom of the heating unit protection cover is provided a through hole, the heating unit passes through the through hole to achieve a substantially coaxial arrangement with the heating unit protection cover, an outer wall of the heating unit protection cover is provided with an annular protrusion, and a side wall of the heating unit protection cover is provided with a limiting groove having a height substantially equal to a height of the heating unit protection cover and arranged in a longitudinal axial direction;

a heating cavity shell, wherein heating cavity shell is sleeved outside the heating unit protection cover, an inner wall of the heating cavity shell is provided with an annular groove, the annular groove is matched with the annular protrusion to enable the heating cavity shell to rotate in situ around the heating unit protection cover, the inner wall of the heating cavity shell is further provided with a sliding guide groove, wherein the sliding guide groove has a spiral shape; and a cigarette holding cavity, wherein an outer wall of the cigarette holding cavity is provided with protrusions, the protrusions penetrate through the limiting groove and an end of each of the protrusions is limited in the sliding guide groove.

2. The electronic heating smoking paraphernalia capable of being rotated to extract the cigarette according to claim 1, wherein a length of the sliding guide groove extending in a longitudinal axial direction is less than or equal to a length of a section of the heating unit inserted into the heating unit protection cover.

3. The electronic heating smoking paraphernalia capable of rotating to extract the cigarette function according to claim 1, further comprising a housing, wherein a battery, and a controlling and fixing module are provided in the housing, the heating unit is electrically connected to the battery and the controlling and fixing module, and fixed on the controlling and fixing module.

4. A method for extracting a cigarette by rotating a smoking paraphernalia, wherein the smoking paraphernalia is an electronic heating smoking paraphernalia capable of being rotated to extract the cigarette the method comprising:

a heating unit;

a heating unit protection cover having a cylinder-like shape, wherein a center at a bottom of the heating unit protection cover is provided a through hole, the heating unit passes through the through hole to achieve a substantially coaxial arrangement with the heating unit protection cover, an outer wall of the heating unit protection cover is provided with an annular protrusion, and a side wall of the heating unit protection cover is provided with a limiting groove having a height substantially equal to a height of the heating unit protection cover and arranged in a longitudinal axial direction;

a heating cavity shell, wherein heating cavity shell is sleeved outside the heating unit protection cover, an inner wall of the heating cavity shell is provided with an annular groove, the annular groove is matched with the annular protrusion to enable the heating cavity shell to rotate in situ around the heating unit protection cover, the inner wall of the heating cavity shell is further provided with a sliding guide groove, wherein the sliding guide groove has a spiral shape; and a cigarette holding cavity, wherein an outer wall of the cigarette holding cavity is provided with protrusions, the protrusions penetrate through the limiting groove and an end of each of the protrusions is limited in the sliding guide groove;

, and the method comprises the following steps:

a: rotating the heating cavity shell, wherein owing to the existence of the annular groove on the inner wall of the heating cavity shell and the annular protrusion on the outer wall of the heating unit protection cover, and a longitudinal limiting effect, the heating cavity shell merely rotates in situ around the heating unit protection cover rather than moves longitudinally;

b: in a rotation process, the sliding guide groove in the heating cavity shell applying a force to the protrusions on two sides of the cigarette holding cavity, wherein since the sliding guide groove is in the spiral shape, the protrusions penetrate through the limiting groove on the heating unit protection cover and the heating unit protection cover doesn't rotate, rotations of the protrusions are limited, so the protrusions merely move in a longitudinal direction defined by the limiting groove, and drive the cigarette holding cavity to move in the longitudinal direction, and then drive the cigarette in the cigarette holding cavity to move in the longitudinal direction, the cigarette gradually moves away from the heating unit till being pulled out of the heating unit eventually.

5. The method for extracting the cigarette by rotating the smoking paraphernalia according to claim 4, wherein the step b is followed by step c which comprises:

c: reversely rotating the heating cavity shell along the heating unit protection cover, then the cigarette holding cavity longitudinally moving along the limiting groove and returning to an original position, for a next cigarette to insert for smoking.

6. The method for extracting the cigarette by rotating the smoking paraphernalia according to claim 4, wherein a length of the sliding guide groove extending in a longitudinal axial direction is less than or equal to a length of a section of the heating unit inserted into the heating unit protection cover.

7. The method for extracting the cigarette by rotating the smoking paraphernalia according to claim 4, wherein the electronic heating smoking paraphernalia capable of being rotated to extract the cigarette further comprises a housing, a battery and a controlling and fixing module are provided in the housing, the heating unit is electrically connected to the battery and the controlling and fixing module, and fixed on the controlling and fixing module.

* * * * *